US007900410B2

(12) United States Patent
Skendzic et al.

(10) Patent No.: US 7,900,410 B2
(45) Date of Patent: Mar. 8, 2011

(54) CONSTRUCTING THE LARGE-SPAN SELF-BRACED BUILDINGS OF COMPOSITE LOAD-BEARING WALL-PANELS AND FLOORS

(75) Inventors: Milovan Skendzic, Lepoglava (HR); Branko Smrcek, Trnovec (HR)

(73) Assignee: Mara-Institut d.o.o, Donji Martijanec (HR)

( * ) Notice: Subject to any disclaimer, the term of this patent is extended or adjusted under 35 U.S.C. 154(b) by 1083 days.

(21) Appl. No.: 10/560,424

(22) PCT Filed: Jul. 2, 2003

(86) PCT No.: PCT/HR03/00034

§ 371 (c)(1),
(2), (4) Date: May 30, 2006

(87) PCT Pub. No.: WO2005/003481

PCT Pub. Date: Jan. 13, 2005

(65) Prior Publication Data

US 2006/0230706 A1 Oct. 19, 2006

(51) Int. Cl.
*E04B 1/00* (2006.01)

(52) U.S. Cl. ..... 52/251; 52/236.5; 52/236.7; 52/241; 52/258; 52/442

(58) Field of Classification Search ..... 52/309.7, 52/309.9, 309.11, 309.12, 309.14, 309.16, 52/309.17, 323, 405.3, 407.1, 653.2, 235, 52/236.5, 236.6, 236.7, 236.8, 251, 258, 52/239, 240, 241, 242, 439, 442, 259, 263, 52/807, 808, 656, 657, 658
See application file for complete search history.

(56) References Cited

U.S. PATENT DOCUMENTS

| | | | | | |
|---|---|---|---|---|---|
| 3,336,709 | A * | 8/1967 | Berney et al. | 52/309.3 |
| 3,757,482 | A * | 9/1973 | Haeussler | 52/405.3 |
| 3,996,713 | A * | 12/1976 | Haeussler | 52/309.12 |
| 4,359,848 | A * | 11/1982 | Haeussler | 52/405.3 |
| 4,489,530 | A * | 12/1984 | Chang | 52/745.09 |
| 4,649,682 | A * | 3/1987 | Barrett, Jr. | 174/480 |
| 4,669,240 | A * | 6/1987 | Amormino | 52/236.6 |
| 4,674,250 | A * | 6/1987 | Altizer | 52/309.7 |
| 5,440,845 | A * | 8/1995 | Tadros et al. | 52/309.12 |
| 5,881,516 | A * | 3/1999 | Luedtke | 52/236.3 |
| 2003/0192272 | A1 * | 10/2003 | Bravinski | 52/309.11 |
| 2004/0003565 | A1 * | 1/2004 | Konopka | 52/506.03 |

FOREIGN PATENT DOCUMENTS

WO 93/23632 11/1993

* cited by examiner

*Primary Examiner* — Brian E Glessner
*Assistant Examiner* — Theodore Adamos
(74) *Attorney, Agent, or Firm* — Jacobson Holman PLLC

(57) ABSTRACT

Large span buildings without ordinary beams and columns are formed of vertical load-bearing composite wall-panels and composite floors, both including two concrete layers interconnected by steel strip webs. The stiff horizontal plane formed of assembled roof/ceiling units, supported by wall-panels, connected to both gables restrains transversal movement of longitudinally arranged wall-panels attached tops, bracing them simultaneously against sideway forces and lessening their buckling lengths. Floors, if any applied, being rigidly connected to the vertical panels additionally improve stability of the global structure. The structure, being braced in that way, behaves as a rigid box made of slender panels.

2 Claims, 8 Drawing Sheets

CONSTRUCTING THE LARGE-SPAN SELF-BRACED BUILDINGS OF COMPOSITE LOAD-BEARING WALL-PANELS AND FLOORS

TECHNICAL FIELD

The present invention relates to the construction of floors of industrial or other similar buildings of prestressed, reinforced concrete and in particular some steel parts become integral parts of the structure. The field of the invention is described in IPC Classification E 04 B 1/00 that generally relates to constructions or building elements or more particularly group E 04 C 3/00 or 3/294.

BACKGROUND ART

The intention of the present invention is to establish a new assembling system for constructing large span buildings formed of composite vertical load-bearing wall-panels and composite floors whereby lateral bracing and stability of the structure is achieved using slender wall and floor elements only, needing no additional stabilizing construction. As a final task there was a challenge to construct the clear, large-span building with plane inner and outer surfaces, containing no ordinary beams and columns extending out of them. How it is done is described in following disclosure of the invention.

It is of importance to emphasize that the present invention relates to large-span, low-rise buildings (of about 20 to 30 m span, up to 15 m height), intended mainly for constructing industrial and similar buildings to which many similar wall-panel systems, in present state of art have never been applied. In most common practice of constructing low-rise concrete buildings of wall-panels the non-bearing curtain walls, requiring additional structural supports, are predominant. Pure wall-panel load-bearing, self-stable, constructions appear very seldom. Some of wall-panel building systems may have more or less similar elements to those of the building system disposed in the present invention but are due to their unreal solutions essentially restricted about being applied to large span buildings. Self-supported structures of load-bearing wall-panels require application of panels having a considerable stiffness, capable of bearing huge vertical loads and horizontal forces ensuring simultaneously stability of the global structure. The main reason why pure wall-panel load-bearing constructions appear so seldom is exactly the stability of the structure which is difficult to be ensured through use of strong panels only. In such a case, panels can not be slender but require significant depth whereby increasing the panel depth increases greatly spend of material which, dependably on height of the building, may become excessive. Too deep wall-panels may become also too weighty or unaesthetic. The depth of the panel, from which the wall panel derives its stiffness, is actually obtained by increasing the distance between the two concrete layers whereby the gap remaining between them has to be filled with some material. Whichever material used to fill the gap makes a significant expense when summarized over large wall areas of the building. Obviously, the depth of the panel has somehow to be increased without spending too much material and that is also one of tasks this invention deals with. But even if increase of the depth of the panel is succeeded in an economic way, getting in that way a stiff load-bearing wall-panel, it still won't be enough to assure stability of the structure when subjected to large vertical and horizontal load and won't decrease enough deflections of panel tops under lateral loads as well as many other requirements of building codes too. The most common large-span-building are constructed of assembled laterally unbraced transversal frames with cantilever-columns or analogously cantilever vertical wall-panels supporting the weighty roof construction so that the vertical cantilever load-bearing columns or panels, having the buckling length twice long as their actual height is, support transversal beams or slab-like roof constructions. Stability of such structures based upon strong laterally unbraced cantilever-columns (or adequate wall-panels) is perhaps the most expensive manner to be paid for stability. Leak of efficient lateral bracing makes such structures unsuitable to be stabilized economically, requiring large cross-sectional dimensions of columns or panels. In accordance with that, the further task of the present invention is to stabilize the structure in some other way lessening in thereby the requirements on panels to be extremely deep. More particularly, what is seek is some transversally braced structure assembled of vertically-placed, load-bearing wall-panels of a moderate depth; whereby stability of the structure is achieved by including all available resources of the structure. Thus, wall-panels could be in that way partially relieved from being the only element which stability is based upon. The manner how it is done is described in disclosure of the invention. Several solutions that I know, may have some partial similarity with the present solution but they were generally neither occupied with the problem of stability nor with applicability to construct real large span buildings. Since the new building system is based upon two solutions whereby the first one seeks to improve the panel and floor unit themselves and the other one relates to the stability of the structure, these two problems will be considered separately.

The most similar solution of the vertically placed, load-bearing wall-panel I know was disclosed by U.S. Pat. No. 4,669,240 written by inventor Giuseppe Amormino. The disclosed patent provides an idea for a load-bearing, sandwich wall-panel which generally suits well the purpose of constructing buildings. But still, the panel contains several weak points which may seriously limit its range of applicability for constructing real large span buildings, as follows. The arrangement of wire mesh reinforcement placed in the middle of the cross-section of each thin concrete layer makes them too flexible. Since the real distribution of axial forces along the panel height is rather eccentric than centric, layers are often subjected to some unavoidable local bending. The reinforcement placed in the middle of the cross section is therefore unsuitable. The present invention introduces a new arrangement of two interspaced layers of mesh reinforcement placed closely to concrete surfaces as will be disclosed. In that way both the panel concrete are significantly strengthened.

The steel rod trusses used in above mentioned application as shear connectors to connect concrete layers, ensuring composite action of the panel, might be not satisfactory rigid for use in higher, slender panels. In such a case there have to be provided many of them. Using of too many trusses requires using of too many smaller pieces of insulating strips, requiring also much more welding, making in that way manufacturing process of the same more time consuming. For that reason, in the present invention the truss connectors are replaced by les pieces of more rigid steel webs which are much stronger, continuously anchored to both the concrete layers. In the same patent, the floor support formed of inner concrete layer being thickened at its top to provide a sufficient bearing surface is awkwardly made for it causes eccentricity. Vertical load, of a great amount is thereby transmitted through such a support causes unnecessary local bending moments, causing permanent stresses in panel elements. Moreover, in such a way the roof/floor is practically supported by one thin inner concrete layer only, having reinforcement placed in the middle. Such load concentrations require more serious supports than presented one. Further deficiency relates to manufacturing of the panel, particularly to the method how the bottom of the mould for the upper concrete layer is temporary fixed to trusses as well as the queer of using a "suitable resin" for bonding fiberglass strips interposed between adjacent pairs of trusses. Final step of filling the "grout or insulation material" into spacing between adjacent insulation strips may be unacceptably time consuming work to do for a quick production. The present invention introduces more efficient way of making panels.

There are many solutions of load-bearing wall-panel as well as many methods of constructing buildings of them in present state of art. However, such building systems are not widely spread in common practice, especially were not applied in large-span low-rise industrial and similar constructions. One of reasons for that is certainly a leak of stability of such buildings that is difficult to be ensured through panels alone, especially when spans are over 20 m and heights of panels exceed 9 m. All solutions for constructing wall-panel buildings that I know do not deal with problems of stability at all.

DISCLOSURE OF THE INVENTION

This invention concerns with constructing the self-stable, low-raised large-span industrial and similar buildings of composite load-bearing wall-panels, without using of ordinary elements such as columns, beams, or supporting frames as commonly used parts for ensuring stability of the global structure of the building. For that reason, the predominant part of this disclosure deals with stability, bracing the assembled structure against sideway helping panels to support weighty roof and floors. The new invented composite wall-panel is intended to adapt the commonly known wall sandwich panel for constructing large span structures as well as for the quick production. To complete a system for constructing self-stable, large-span structures assembled of slender vertical load-bearing panels, several inventions were introduced. To put the things in order, wall-panel, floor element, apparatus for manufacturing and method of erecting buildings will be disclosed in following one after another separately.

The new composite panel, as shown in FIGS. 1, and 4, provides enhanced, commonly used structural load-bearing sandwich wall-panel consisting of inner and outer concrete layers, interconnected by at least two longitudinal steel-sheet strips galvanized against corrosion. The gap between two concrete layers is partially filled with a layer of thermo-insulation of arbitrary depth. The rest of the gap remains empty being used for air circulation. The main feature achieved, besides well known properties of the structural sandwich, is a depth-adaptability which is available without considerable spending of material. Increasing the space between two concrete layers significantly enlarges moment of inertia of the cross-section of the panel whereby it is done by increasing the height of the steel web-strips that is almost negligible increase of material spend. What is really increased is the width of the air space between two concrete layers which cost nothing. Hence, the wall-panel, deriving its strength from lessening its slenderness (as its moment of inertia increases), becomes stronger by getting its concrete layers more apart, it is a small price to be paid to obtain a strong panel. The most commonly used steel trusses connecting the two concrete layers are hereby replaced by the steel strip webs which suit much better the purpose of constructing heavy buildings for several reasons: Firstly, steel strips are substantially stiffer than trusses. Steel webs, having considerable cross-section area, being strongly anchored to both the concrete layers can contribute in bearing some amount vertical load. Vertical load applied to the steel tube at the support is partially transmitted to the surrounding concrete to which the tube is anchored and partially along the two long continuous joining lines between the both concrete layers and the steel web, as shown in FIGS. 4, and 6, so that stress concentrations at supports are avoided. The amount of steel, spend for applied webs (containing no flanges) is approximately equal to the amount needed for trusses. Generally, more truss pieces then steel webs are needed to obtain the adequate stiffness of the panel which has to be stiff enough to resist lateral deflections within permitted limits. The applied arrangement of two steel mesh layers embedded within each concrete layer greatly increases its local stiffness, lessening simultaneously their possibilities to bend and crack. The short steel rod anchors inserted through holes in loops which are welded at both longitudinal edges of webs, serve primarily as anchors against slippage between concrete and web, keeping also the constant distance (equal to the short steel rod diameter) between two meshes along the concrete layer, as shown in FIG. 1. The reinforcement cage formed upon the mould, prior to concreting each concrete layer is well fixed, easy to place and control, with reliable interspaces what lessens tolerances. It is needed here to emphasize that introducing two steel wire meshes with additional longitudinal reinforcement or prestressing strands between them certainly enables use of less deep thin walls of different concrete elements than usually permitted by codes. However, codes, usually limiting concrete covers of beams and columns do not consider such cases when reinforcement is confined so optimally between two layer meshes.

Another feature of the panel is introduced steel tube, perpendicularly positioned and welded to steel webs between two concrete layers, defining the top of supports for bearing roof or floor construction of assembled units, allowing no eccentricity to occur. Reactions of supported roofs or floors units are thereby applied centrically to the steel tube which is anchored to both concrete layers at the top of the support. The steel tube is hence welded to both steel webs so that reactions are efficiently transmitted to both concrete layers avoiding in that way stress concentrations near supports. The new panel is initially (during assembly) mounted as a cantilever (finally as a cantilever panel with laterally attached top), with its down-end rigidly fixed to the socket of the foundation, as shown in FIG. 11. Consequently, the lower part of the panel has a full concrete cross-section at the length which is predetermined to entry the ground and foundation, below the ground floor-plate, as shown in FIGS. 4 and 8. That is where the largest bending moments occur so the full cross section suits. One more advantage of such a solid bottom is that the wall-panel can be easily erected being rotated about its bottom whereby some chips and crushes of the bottom edges can be accepted because the bottom of the panel finally comes into a socket being poured by concrete. The creep of the capillary moisture upwards the panel can be easily prevented by a suitable external non-hygroscopic coat up to the level of the surrounding terrain. The other possible way of breaking the moisture is inbuilt, moisture breaker. One more object of the invention is the method and apparatus for manufacturing such sort of panels in a rapid way making them suitable for mass production. The manufacturing method concerns with an additional device being part of the mold, providing moveable, temporary fixed bottom of the upper mold part for pouring the upper positioned concrete layer, as shown in FIGS. 9 and 10. The device comprises series of lateral sticks driven through holes in side forms of mould and through holes in steel webs of the panel. The rough-surface insulation strips are used to form the bottom of the upper mold being arranged over tops of bottom sticks, which, after concreting is done, rest one-side adhered to the concrete. After concrete of the upper concrete layer of the panel is hardened the moveable bottom is pulled aside. All the common features of the sandwich panels, that many other panels comprise, are not discussed here but only slightly mentioned because the goal of the present application was to obtain a stiff and load-bearing capable panel reliable to ensure stability of the building. Hence, until now, a reliable panel was disclosed which the real large span buildings can be constructed of.

Another building element, the composite floor unit is made in the similar way as just disclosed wall panel, shown in FIG. 5. It comprises upper and lower cast-concrete layers interconnected by two or more galvanized steel sheet strips interposed into a gap between them, anchored to the concrete in the same manner as those of wall-panel. Both concrete layers of the floor unit, subjected to pure flexure only, are reinforced by two steel wire mesh layers whereby the upper panel unit is thicker than the lower one in order to obtain the higher positioned centroid of the cross section. The compressed upper panel may contain additional reinforcement which is seldom needed because of the wide concrete cross-section area. The lower panel, tensioned due to flexure, is always reinforced by additional reinforcing bars embedded between the two mesh layers. In case of prestressing, reinforcing bars can be, completely or partially, replaced by pre-stressing wire-strands dependably of the desired degree of prestressing. Special benefit of using steel webs occurs near supports where shear forces of a high amount are present. The principal tension stresses are thereby especially suitable prevailed by steel webs. Moreover, if shear stresses occur in an excessive amount, there's a possibility to introduce some additional, shorter steel-sheet strip webs near its ends only which need not to be extended along the entire floor element, as shown in FIG. 5 where the middle web drawn by dashed line illustrates such an additional web. Another benefit of applied steel webs is utilizing them to achieve a rigid steel to steel connection between the wall panel and the floor unit, as shown in FIGS. 4 and 7. Fixing steel webs of the floor element to webs of the wall panel by a couple of bolts a rigid connection is obtained which can additionally improve stability of the building comprising floors. However, application of stiff panels alone, without being braced, allows constructing of only smaller span buildings under a condition that they are not too tall. Such a use of wall panels would surely be restricted to some available range of application limited by bearing capabilities of the panel as well as with its slenderness or by building code requirements. Otherwise, the depth of the wall panel would have to increase enormously what may cause different sorts of architectural problems making them unacceptable. For instance, if simple structure of two cantilever wall-panels, of about 35 cm overall depth, bearing simple supported roof construction of 25 m span, was made, as shown in FIG. 11, the limit of the panel height would be about up to 7 m height. Exceeding that limit, even if ultimate strength and stability under vertical load were satisfactory such a construction doesn't satisfy limitations of lateral deflections of its slender panels when subjected to lateral loads such as earthquake or wind. Hence, the presently invented panel, like many others from the state of art, without being braced would rest only a model for constructing small buildings but not the real ones, having large spans and increased heights. That is why many of earlier patented systems have failed being never widely used in practice. As obvious, constructing the real large-span high low-rise building requires an additional solution of self-bracing against sideway helping the wall-panels to become a self-stable roof/floor supporting structure. In following, such a solution, applicable to buildings containing particularly slab-like roof-ceiling units is disclosed. (beams are more likely to be supported by columns). The basic idea is to brace longitudinal rows of load bearing vertical panels against sideway at the roof-ceiling level by a wide stiff plane formed of interconnected roof-ceiling units being horizontally connected to the two gables, as illustrated in FIGS. 12, 13, and 14. This idea would be nothing new if short-span multi-story buildings were considered, instead of large span ones, whereby strong monolithic floors, poured in situ, connected to shear walls over short spans are present. However, large span low-rise assembled buildings are not constructed in that way because of the absence of possibility to form a proper, large stiff plane capable of connecting two distant wall-panel-assembled gables making them to serve as shear walls. The simplest structure is formed of two longitudinally aligned rows of erected wall-panels supporting the flat-soffit roof-ceiling constructions as shown in FIG. 11. Hereby, applied roof-ceiling constructions were disclosed in WO 02/053852 A1. Each pair of wall-panels supports one single roof-ceiling unit as illustrated. Wall-panels are thereby rigidly inbuilt in longitudinal strip foundations containing longitudinal sockets. Such a structure is stable until slender cantilever wall-panels can maintain their own stability. But as the height of the building increases slenderness of wall-panels grows up in a fast rate and the structure becomes unstable. The depth of the wall-panel has no sense to be increased over some architecturally and economically reasonable value so the limit of the structure is reached pretty soon. Interconnecting now adjacent soffit plates of the roof-ceiling units by plurality of simple welded details of an arrangement shown in FIG. 14, the wide, extremely stiff horizontal plane is obtained which is in the same manner connected at its ends (through last soffit plate longitudinal edges) to both gables. The gables being assembled themselves too of wall-panels are right-angularly directed to longitudinal walls and have an extremely large stiffness in their own plane are capable to ensure transversal bracing of the structure. Such gables become in fact shear walls. In such a way, the long and wide stiff horizontal plane, being vertically supported by wall-panels itself, holds tops of the same wall-panels restraining them from movement in horizontal lateral direction as shown in FIG. 14. As the tops of longitudinally arranged wall-panels are attached to the stiff horizontal plane, panels are no more simple vertical cantilevers but become cantilevers having laterally restrained tops and consequently can not buckle in a previous manner. Restraining lateral movement of their tops significantly decreases buckling length of panels as well as their slenderness. Reduction of the buckling length (denoted by $L_b$) of the wall-panel is illustrated by a comparison made in FIGS. 15 and 16. FIG. 15 illustrates sideway of unbraced cantilever wall-panel row due to action of vertical and horizontal load without being helped by gables. FIG. 16 illustrates buckling of the same cantilever wall-panel row being braced by gables through the horizontally stiff plane, due to the same load action. It is seen that in second case the buckling length is significantly reduced what is advantageous in sense of stability of the structure. This advantage will be now proved theoretically.

However, being considerably large the rigid horizontal plane is laterally flexible itself, dependably on the length of the building and due to presence of plurality of relatively thin-elastic steel connectors. The horizontal plane acts as a spring attached laterally to the top of a vertical panel, as schematically shown in FIG. 16. Referring now to the FIG. 16, the critical load $P_{cr}$ is determined from a static condition $$N_{cr}\cdot\delta = c\cdot\delta\cdot L + \frac{3EI}{L^3}\cdot\delta\cdot L$$

wherefrom $$N_{cr}\cdot\delta = c\cdot\delta\cdot L + \frac{3EI}{L^3}\cdot\delta\cdot L$$

and $$\boxed{N_{cr} = c\cdot L + \frac{3EI}{L^2}}$$

Compared to the well-known expression for critical load of cantilever-panel (as shown in FIG. 17)

$$N_{cr}^2 = c\cdot L + \frac{3EI}{L^2}$$

$$N_{cr}^1 = \frac{\pi^2\cdot EI}{4L^2} = \frac{9{,}8596\cdot EI}{4L^2} = 2{,}465\frac{EI}{L^2}$$

neglecting the difference and taking the two expressions approximately equal $$3\frac{EI}{L^2} \approx 2{,}465\frac{EI}{L^2}$$

it is obtained $$N_{cr}^2 \approx c\cdot L + \frac{3EI}{L^2} = c\cdot L + N_{cr}^1$$

Thus, the critical force of the cantilever hold with spring at its top differs from the critical force for the pure cantilever in member k·L. The constant of the spring c, characterizing mutual stiffness of the roof plane and gables, of a large value, makes the top of the column practically restrained like as if it was a vertically moveable pinned end. Even if the spring constant c was of only a slight value it would cause a significantly reduction of buckling shape of the wall-panel and that is a benefit whereby the critical load substantially rises anyway. Stiff springs, representing real stiffness of the horizontal planes, may several times increase the critical load of the same panel. The buckling length is found from following consideration. The well-known expression for the critical load of the column member is generally $$N_{cr} = \frac{\pi^2\cdot EI}{k\cdot L^2}$$

For cantilever column with lateral spring at its top was obtained $$N_{cr} = c\cdot L + \frac{3EI}{L^2}$$

where c is a spring constant equalizing, these expressions we get $$\boxed{k = \frac{\pi^2\cdot EI}{C\cdot L^3 + 3EI}}$$

This formula is needed to determine the actual slenderness of the panel consequently $$\lambda = \frac{k\cdot L}{i} = \frac{\frac{\pi^2\cdot EI}{C\cdot L^3 + 3EI}\cdot L}{\frac{I}{A}} = \frac{\pi^2\cdot i\cdot EI}{C\cdot L^2 + \frac{3EI}{L}}$$

and slenderness of the panel is $$\boxed{\lambda = \frac{\pi^2\cdot i\cdot EI}{C\cdot L^2 + \frac{3EI}{L}}}$$

The spring constant c can be pretty accurately determined by any structural analysis computer program from the model of the building comprising modeled joints. Stiffness of the horizontal plane assembled of roof/ceiling soffit plates will depend on the length of the plane, span of assembled units and predominantly on deformability of connections. The spring constant will also depend on flexibility of gables whereby larger openings within gables must be taken in account. Knowing the horizontal force H and its horizontal deflection computed through the modeled horizontal plane it is easy to obtain the flexural stiffness of the equivalent longitudinal frame $EI_F$, comprising combination of equivalent beam substitute $EI_b$ and equivalent column substitute $EI_c$, replacing horizontal plane and gables respectively, as shown in FIG. 17. The true values can be measured on real model and introduced as correction factors into above expression.

The maximal deflection occurred at top of the longitudinal frame in transversal direction comprises two parts, deflection due to bent columns (gables) $f_c$ and deflection of the beam (horizontal plane) $f_b$, as shown in FIG. 17.

$$f_{max} = f_c + f_b$$

$$f_b = H\frac{\varphi\cdot L_b^3}{48EI_b}$$

$$f_c = \frac{H}{2}\frac{L_c^3}{3EI_c}$$

$$f_b = H\frac{\varphi\cdot L_b^3}{48EI_b}$$

$$f_{max} = \frac{H}{2}\frac{L_c^3}{3EI_c} + \varphi\frac{H\cdot L_b^3}{48EI_b}$$

Finally, the bracing spring constant is obtained to be $$K = \frac{H}{f_{max}} = \frac{H}{\frac{H}{2}\frac{L_c^3}{3EI_c} + \varphi\frac{H\cdot L_b^3}{48EI_b}}$$

$$\boxed{K = \frac{6E}{\frac{L_c^3}{I_c} + \varphi\frac{L_b^3}{I_b}}}$$

where $I_c$-$\Sigma I_c$—Summary of moment of inertia of the gable panels $I_b$—Moment of inertia of the horizontal plane $L_c$—Average height of the gable panel $L_b$ —Length of the building $\phi$—Reduction factor taking in account decrease of stiffness of the horizontal plane due to yielding of connections. It can be computed from the model or determined by experiment.

DESCRIPTION OF THE PREFERRED EMBODIMENT

Figure 1:
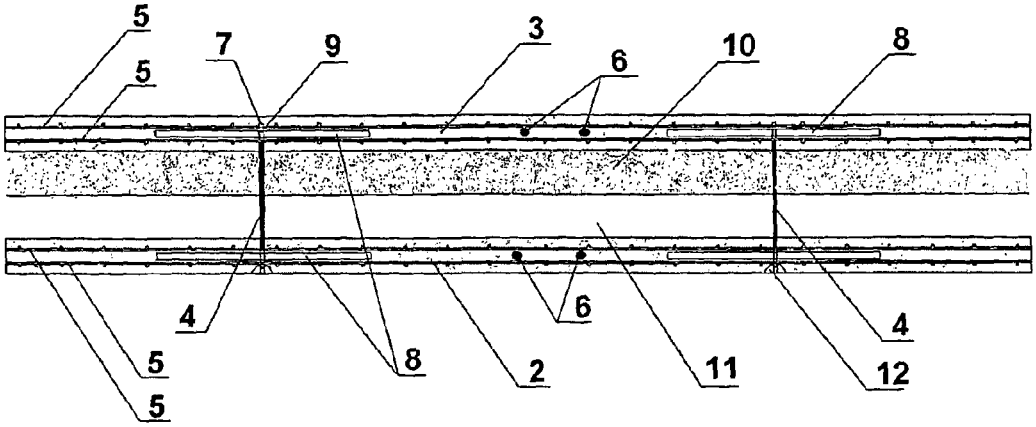
FIG. 1 is the cross-sectional view of the panel showing its constitutive parts
Figure 2:
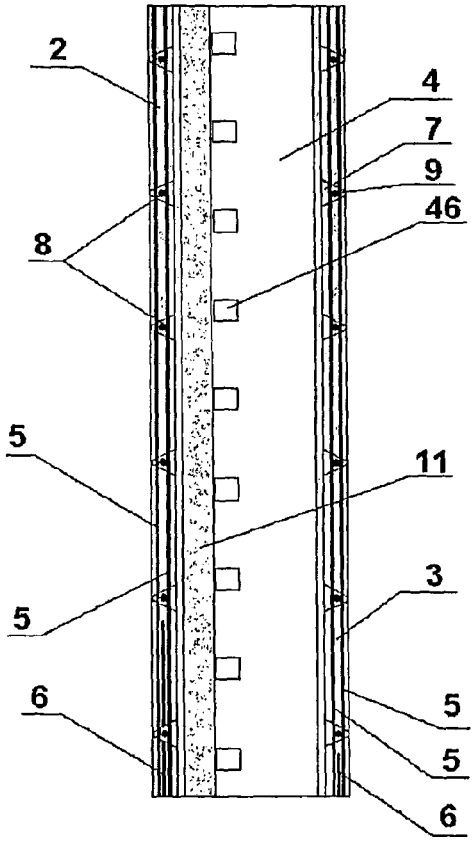
FIG. 2 is a fragmentary vertical cut of the panel
Figure 3:
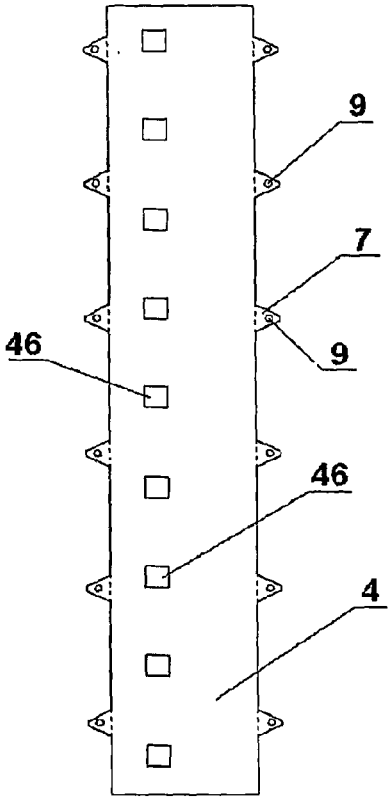
FIG. 3 is a fragmentary view of the steel web of the same fragmentary portion shown in FIG. 2
Figure 4:
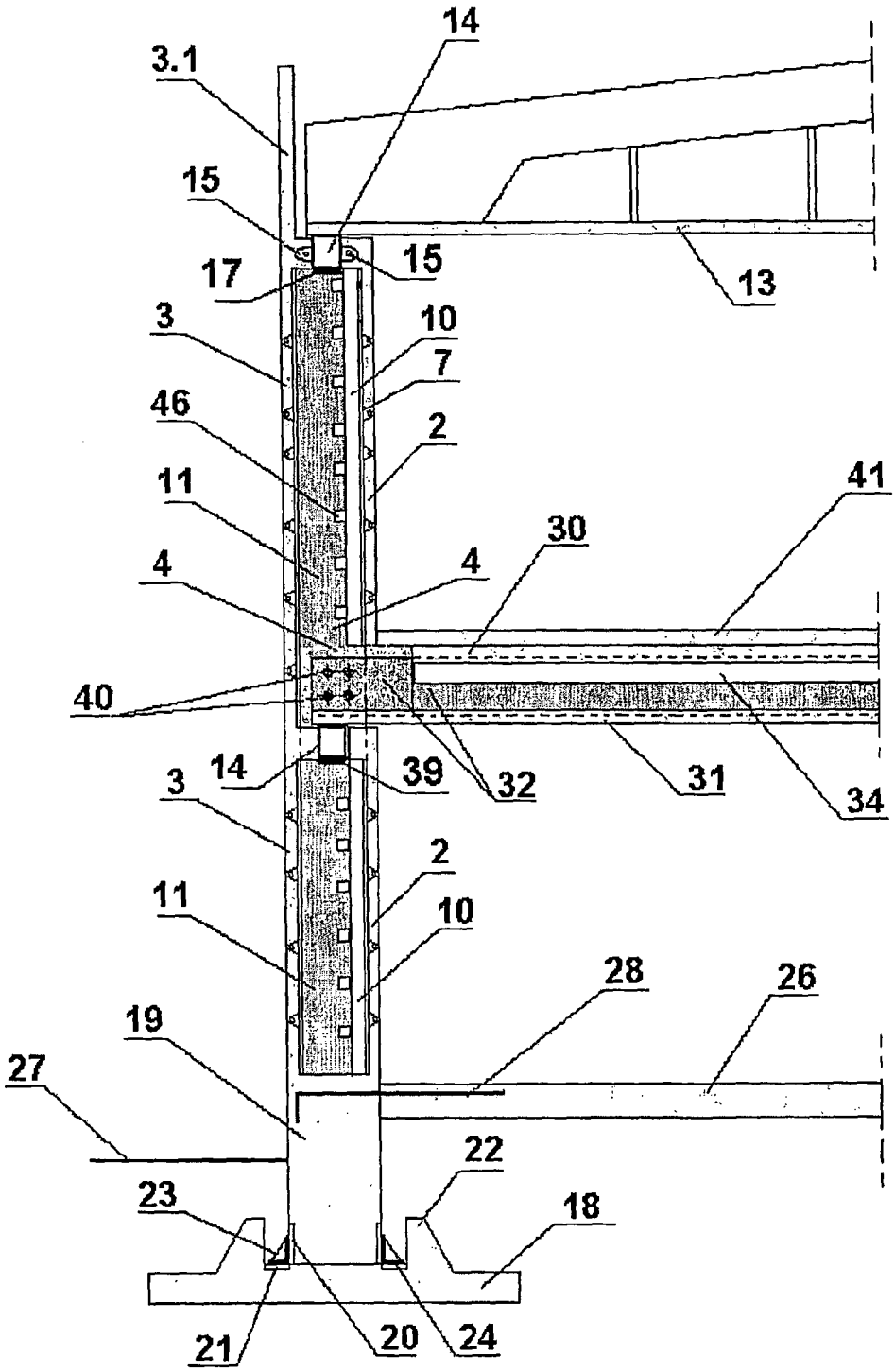
FIG. 4 is a general view of the composite floor unit

The description is set out under the following headings:

a) Wall panel b) Floor element c) Apparatus for manufacturing the wall-panel d) Method of erecting a building a) The composite wall-panel (1) shown by a cross section view in FIG. 1, by fragmentary longitudinal section in FIG. 2 and as a part of building in FIG. 4, comprises a cast concrete inner (2) and outer layer (3), both about 70 mm thick. The concrete elements are interconnected by at least two galvanized steel sheet strips (4) interposed into a gap between them. Both concrete panel elements (2) and (3) are substantially reinforced by two steel wire mesh layers (5). There's rather enough of free space between the two steel mesh layers in each concrete layer, across the width of the panel, whereto additional longitudinal reinforcing bars (6) can be placed, used for strengthening the panel, if necessary. Reinforcing bars can be replaced by pre-stressing wire-strands (completely or partially) dependably of the desired degree of pre-stressing. However, it is an ideal position for reinforcing bars (or pre-stressing wire-strands) to be embedded strongly both-side confined by two layers of meshes. The 4-7 mm thick steel-sheet-strips (4) are embedded into both inner and outer concrete layers being anchored thereto by series of triangle-shaped steel loops (7) with short steel rod anchors (8) being pulled through holes (9) as illustrated in FIGS. 1, 2 and 3. Steel rod anchors (8) both-side projecting from loops (7) are placed exactly between the two mesh layers (5) of each cast-concrete panel elements (2) and (3), keeping in that way the constant distance between the two steel meshes layers. The short steel rod anchors (8) being properly anchored to concrete serve simultaneously as strong connectors. The insulation layer (10) fills only partially the gap between the two concrete panel elements (2) and (3), adhering to the inner side of the inner concrete layer (2) of the wall panel. The unfilled remainder of the gap provides an air zone (11) serving to ventilate the insulation. The overall depth of the wall-panel (1) as well as a relation between the depth of air space (11) and the depth of insulation (10) is arbitrary, dependably on the local climate requirements and is easy adaptable by changing the insulation thickness within the manufacturing process.

Figure 6:
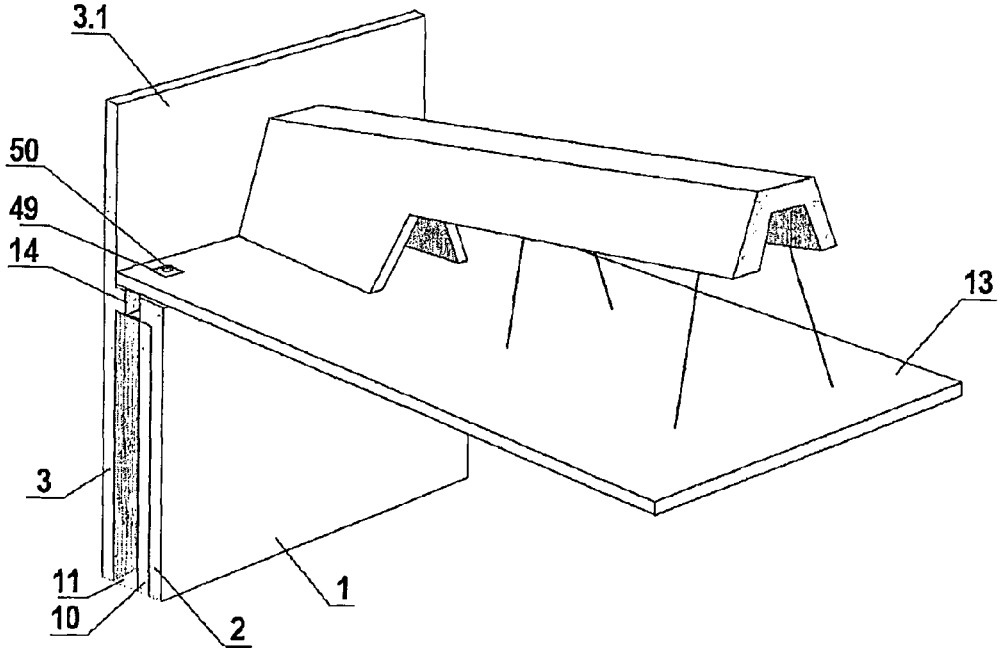
FIG. 6 is a detailed perspective view of the final roof/ceiling unit support attached to the wall-panel
Figure 8:
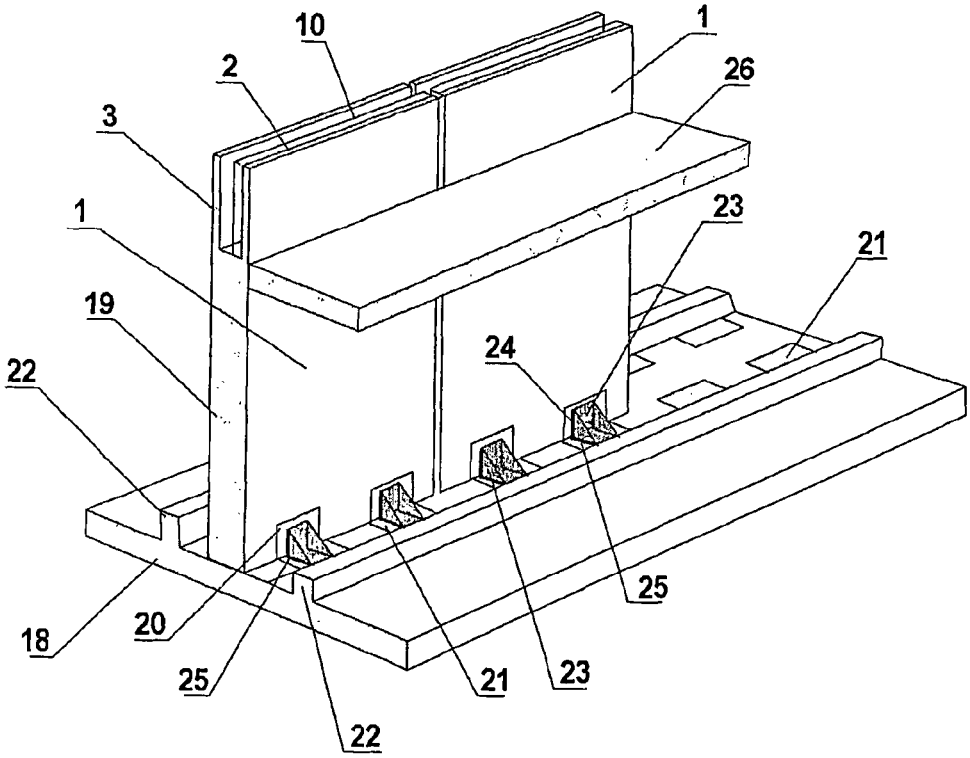
FIG. 8 is a detailed perspective view of lower portion of the wall-panel illustrating its rigid connection to the foundation base

The upper part of the inner panel layer (2), being shorter than outer one (3) as shown in FIGS. 4 and 6, defines the support level for roof-ceiling elements (13), supported by the panel. Thus, the top end portion (3.1) of the outer panel element (3) extends upwards beyond the support hiding the roof construction (13) from being visible from outside. The top support is formed of a small-size steel tube (14) anchored laterally into both concrete layers (2) and (3) thickened near support, through several steel loops (15) projecting laterally outwards by long rod anchors, in the similar manner as webs were anchored. Both panel concrete layers (2) and (3) are thickened near the support for accommodating lateral loops (15) of the tube (14), at a necessary length, needed to transfer reactions of leaned roof elements (13), gradually from the tube (14) to both the concrete layers, avoiding thereby stress concentration. The tube (14) is also welded to both webs (4) by welds (17) for the same reason. The steel tube (14), being a direct support itself, projects slightly upwards over the top of surrounding concrete ensuring in that way the roof-ceiling elements (13) to be leaned exactly against it. Through the tube (14), the wall-panel is loaded centrically, with both concrete layers being compressed equally when lateral forces are absent. The present wall-panel (1) is initially (during assembly) mounted and rigidly connected to the precast foundation elements (18) as a cantilever, as shown in FIGS. 4 and 8. The lower portion (19) of the wall-panel is made as a full solid concrete without insulation, being adapted for placing under the ground level and supplied by small steel plate inserts (20) for fixing on a foundation. The wall panel is fixed on longitudinal strip foundation precast elements (18) through a couple of incorporated steel plates (20) near its lower end, laterally at both sides. Similar steel plates (21) are incorporated at predetermined points along the bottom of the shallow socket (22) of the strip foundation elements (18). When erected, the wall-panel (1) stands uprightly leaned against the foundation bottom being firstly adjusted to a perfect vertical position in any usual manner. The steel plates (20) and (21) are then interconnected by triangularly shaped steel plates (23) positioned perpendicularly to them, welded by welds (24) and (25) respectively, as seen from FIGS. 4 and 8. In an another embodiment, the steel plates can comprise special details projecting at both sides of the panel which are intended to be slipped with their holes upon bolts vertically projecting upwards from the top of the foundation channel bottom being fixed there by nuts. The footing is below the ground at a predetermined depth. The full concrete solid section of the panel near its lower end is applied over length from its bottom in socket (22) up to the upper level of the concrete ground plate (26) poured in situ, that is usually over the ground surface level (27) as visible in FIGS. 4 and 8. The wall-panel (1) is horizontally attached to the massive concrete ground plate (26) by lateral anchors (28).

b) The floor element (29) comprises upper (30) and lower (31) cast-concrete panel elements interconnected by two or more galvanized steel strip webs (32) interposed into a gap partially filed with insulation (33) partially containing air space (34) between them, anchored in the same manner as those of panel. Both concrete layers are reinforced by two steel wire mesh layers in the same as layers of wall panel as obvious from FIG. 1.

Figure 5:
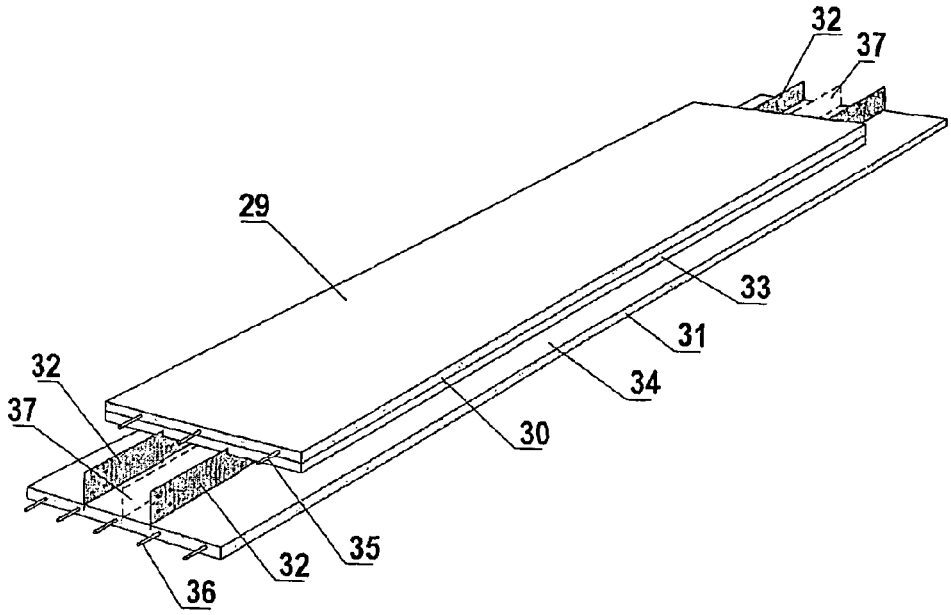
FIG. 5 is a fragmentary vertical section of a one-side portion of a building construction illustrating assembly of vertically assembled panel with, floor and roof-ceiling

The upper panel element (30) is thicker than the lower one (31) so that the higher position of the cross-section centroid is obtained needed for flexure. If needed, the upper panel element (30) of the floor unit may contain some additional compression reinforcement (35) as seen in FIG. 5, analogously to the wall panel, embedded between the two mesh layers. The tensioned lower panel (31) of the floor unit (29) is always reinforced by satisfactory amount of additional reinforcing bars (36) embedded between the two mesh layers. Instead of reinforcing bars (36), in the same manner more or less prestressing wire-strands can be used, dependably of the desired degree of prestressing. Some additional shorter steel-sheet strip webs (37), which, don't need to extend along the entire length of the floor element, close to supports can be included in a case of excessive shear forces.

Figure 7:
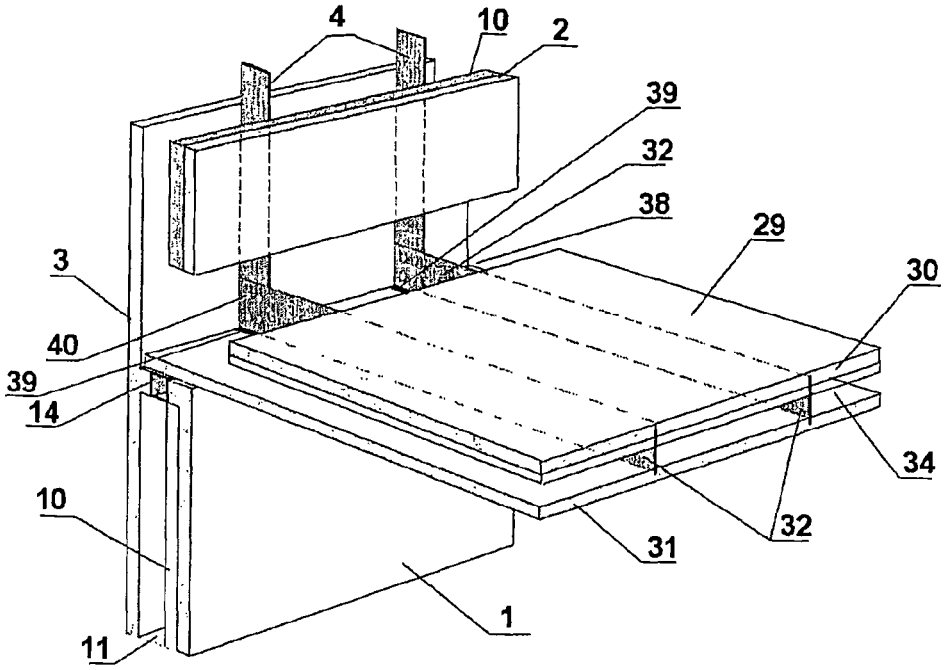
FIG. 7 is a detailed perspective view of the floor unit support, before being poured, illustrating the rigid steel to steel connection between the floor unit and a wall-panel
Figure 9:
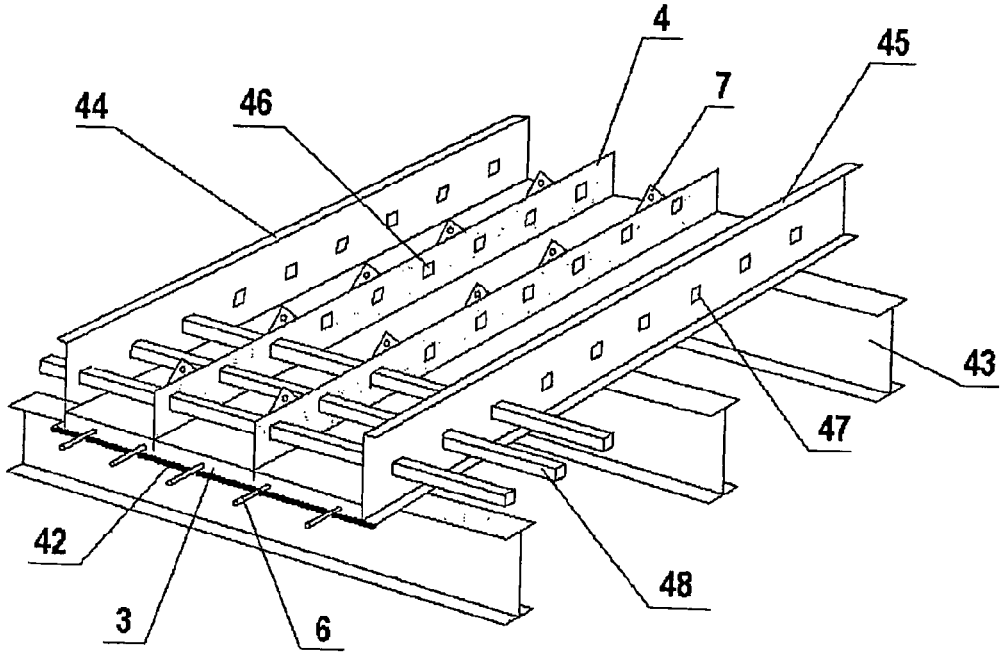
FIG. 9 is a perspective view of the mould fragment illustrating the particular manufacturing stage after the lower concrete layer of the panel was poured
Figure 10:
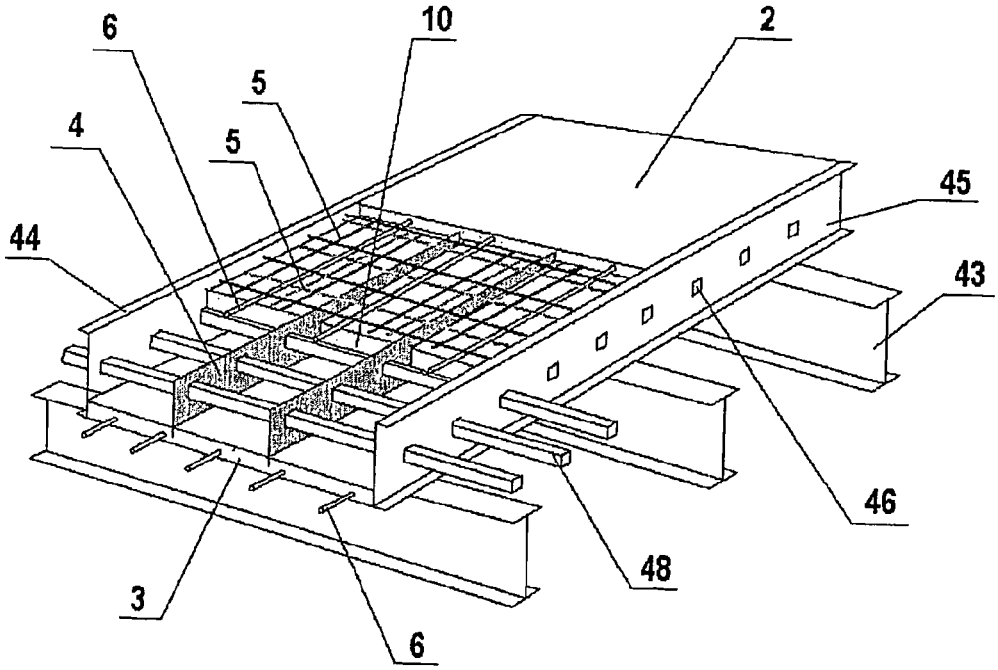
FIG. 10 is a perspective view of the mould fragment illustrating the particular manufacturing stage after the upper concrete layer of the panel was poured
Figure 11:
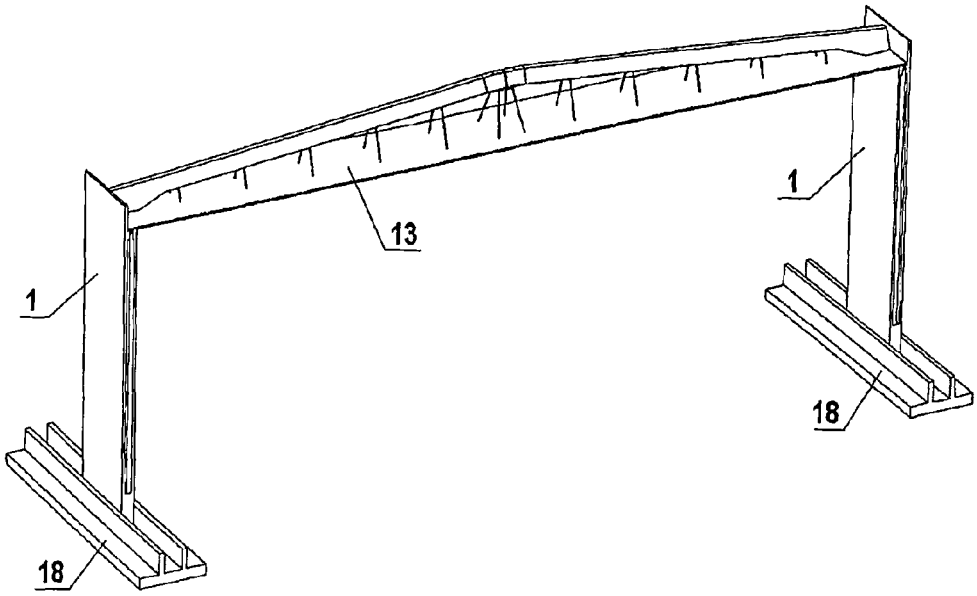
FIG. 11 is an perspective view of simplest transversal frame unit formed of a pair of vertical, cantilever wall-panels supporting the roof-ceiling unit.

Ends of steel webs are utilized to form a rigid connection between the wall panel and the floor unit, as illustrated in FIG. 7. The inner concrete panel element (2) of the wall panel has an interrupt at the support, forming the longitudinal grove (38) for inserting floor elements. The wall-panel (1) comprises a support inside of the horizontal grove (38) at a predetermined level of the floor. The steel tube (39) is used (anchored in the same manner as the tube (14) at the roof support) to assure centrically positioned floor load upon the support. Vertical steel webs of the wall panel (4) passing continuously, without being interrupted, right angularly through the grove (38). The mounted, floor units (29), are leaned against the tube (39) through lower concrete layers (31) having two slots coinciding with and fitting tightly to webs (4) of the wall-panel, as shown in FIG. 7. The vertical steel webs (4) of the wall-panel (1), passing through the horizontal groove (38) strengthen thereby temporarily weakened cross-section of the panel at the groove. When adjusted, the steel webs (4) of the wall-panel and webs of the floor element (32) come overlapped and are easily connected by bolts with nuts (40). The proper access to manage this operation is provided between the wide opening of the groove (38) and shortened upper concrete layer (30) of the floor unit near the support during assembly, whereby, after bolts (40) were tightened, the gap is poured by concrete. The level of the final floor concrete layer (41), poured in site, over the top surface of the assembled floor unit is above the top level of the support grove (38) so finally the entire connection becomes hidden, as obvious from FIG. 4.

c) The mould for manufacturing wall-panels and floor units, illustrated fragmentarily in FIGS. 9 and 10, comprises bottom (42) fixed to some usual rigid sub-construction (43) and the two outer form-sides (44) and (45). The left form side (44) is moveable by sliding aside laterally and the right side form (45) is fixed. Both side forms are perforated longitudinally, along the entire length, with series of rectangle cross-shaped holes (46) arranged at certain distances. The longitudinal arrangement of holes (47) in the mold side forms, coincide to the arrangement of adequate holes (46) in steel web strips (32) or (4) that are used as integral part of the wall panel (1) or the floor unit (29) respectively, when placed into the mould. These holes are utilized to form temporarily the bottom of the upper cast panel element of a wall-panel or a floor unit by inserting plurality of lateral sticks (48), manually or by a special device. To make the matter clearer the manufacturing process will be now described in steps, referring to FIG. 9 and FIG. 10, illustrating the manufacturing procedure at two different stages. Initially, the mould is open by sliding aside the left form side (44) and two layer of reinforcing meshes are placed over the bottom (42). The longitudinal steel web strips (4) (or (32) in case of floor unit) are positioned to stand upright on loops (7) along the mould, perpendicularly to the bottom (42) as visible from FIG. 9. Loops (7) are supplied at their tops by plastic spacers (12) ensuring the proper concrete cover of reinforcement. Since the thin web strips (4) are unstable over the length of the mould they are temporarily braced against turning aside or twisting by few sticks (48) pooled through the corresponding holes of the form sides (46) and through the holes (46) in strips (4) as well, along the mould. Web strips (4) can also be inserted at both mold ends into special vertical slot-jigs. Rising up, the upper layer mesh short steel rod anchors (approximately of 20 cm length) are easily inserted into holes (9) in loops (7) right-angularly directed to the web strips (4) between two layer meshes. The above said is obvious from FIG. 1 and FIG. 9. Steel rod anchors (8) keep the distance between two layers of wire meshes (5) serving simultaneously as anchors for steel web strips (4). After settling all the reinforcement in that way the form sides (44) and (45) of the mold are closed whereby all lateral sticks (48) are pooled aside-out and the lower concrete layer is poured successively to a depth (70 mm) enclosing arranged reinforcement. In case of prestressing, prestressing strands can be placed instead of reinforcing bars in the same manner. Prestressing requires additional sub-construction of the mould comprising strong longitudinal frame with suitable abutments at both ends. The lower positioned concreted layer corresponds to the outer wall element in case of wall panel (with its outer face oriented down) or to the lower concrete element in case of floor unit. The stage after concreting first layer is shown in FIG. 9. After the upper concrete layer was finished, the lateral sticks (48) are pooled through holes in mold sides (46) and passing through holes (47) in all steel web strips (7) as well. At narrow distances arranged lateral sticks (48) form upon their top sides a temporary, one-way grid platform upon which the polystyrene or hard stone-wool insulation strips (10) are placed, being interposed tightly between web strips (4) in between web strips and between web strips and side forms as obvious from FIG. 11. Now the top surface formed of insulating strips (10) defines the bottom of the upper concrete layer mould, closed laterally by same mould sides (44) and (45). The upper mould formed in that way is used for pouring the inner wall element in the case of wall panel or for the upper concrete element in case of floor unit. The loops (7), welded priory to steel webs strips (4), protruding above the insulation surface, comprise holes that are used in the same manner as in the case of the lower concrete element as shown in FIG. 11. Next, the first steel mesh layer (5) is placed into the upper mold, slipped upon vertically standing loops (7) extending over the mesh. Now the short steel rod anchors (8) are inserted into holes (9) before the second mesh layer was positioned, and finally the second mesh layer is placed at the top whereby some additional longitudinal reinforcing bars (6) can be inserted if needed. If there was case of the both side prestressed wall-panel, before placing the last mesh layer some prestressing strands could have been positioned instead of reinforcing bars. The upper positioned concrete layer is then concreted, screeded and trowelled. Both the concrete layers having wide exposed surfaces are easily steam-cured. After concrete of both layers is hardened the lateral sticks (48) are removed by pooling aside-out releasing the wall-panel or floor unit making it ready to be lifted out of the mould. Because of their sufficient rigidity, such panels can be lifted and stored horizontally, in the same position as they were cast.

d) The simplest structure fragment is formed of two vertical wall-panels (1) of the present invention mounted and rigidly fixed into shallow longitudinal socket (22) of the strip foundation elements (18), supporting roof-ceiling units (13) as known under the name "The double prestressed composite roof-ceiling constructions with flat soffit" according to the WO 02/053852 A1, as illustrated in FIG. 11. The two vertical wall-panels (1) were erected and rigidly connected to the longitudinal precast strip foundation in the manner as disclosed in part a). As obvious from FIG. 11, the pair of wall-panels (1) support one single roof-ceiling unit (13) having the exactly equal width as the width of the wall-panel. That is advantageous, because in such a manner perfect compatibility of their connection details is always ensured. Tolerances are thereby consequently decreased to a minimum so that bolts and other precise connecting means can be confidently used without fear of mistakes made by a human error. The roof unit (13) to wall-panel (1) connection is illustrated in FIG. 4 and FIG. 6. The slab-like support end of the floor unit (13) comprises two holes (49) each at one side near ends of the concrete soffit plate, made of incorporated, short steel pipe pieces. The ends of plates are leaned upon the steel tube (14) incorporated between two concrete layers being previously slipped with both holes upon the two bolts (50) extending upright from the top face of the tube (14) and fixed thereto by nuts.

Figure 12:
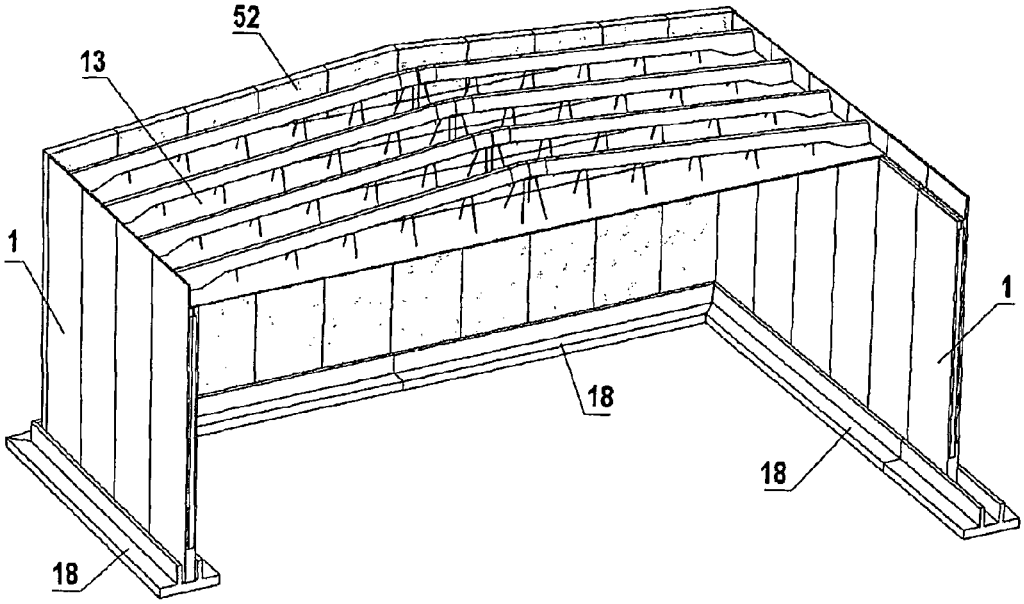
FIG. 12 is a perspective view of a portion of the building in accordance to the present invention
Figure 13:
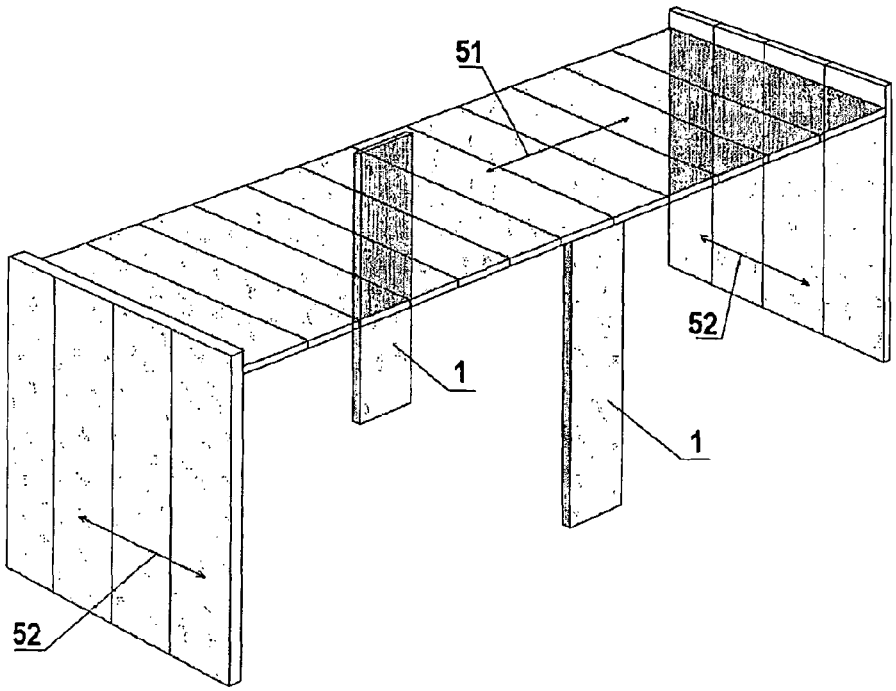
FIG. 13 is a simplified model of the building illustrating the concept of the self stable structure of a building
Figure 14:
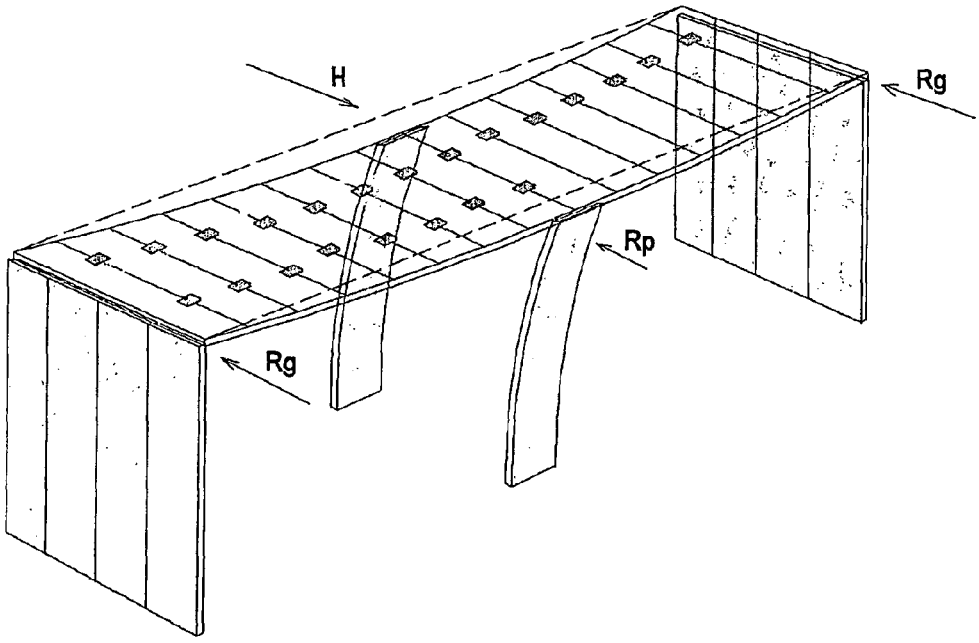
FIG. 14 is a deformed model of the building illustrating how the stability mechanism of the building works
Figure 15:
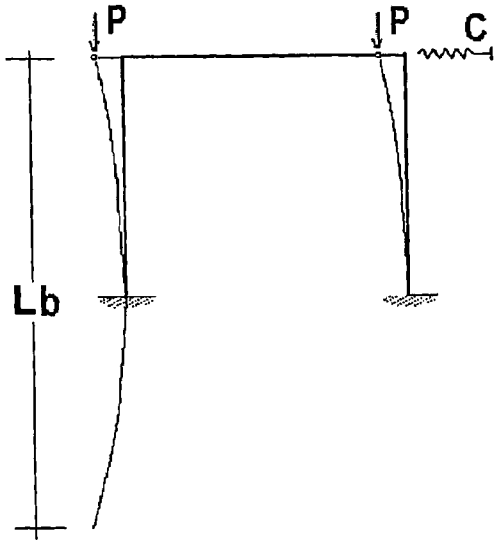
FIG. 15 is a schematic model of a transversal frame of the simplest structure, comprising cantilever wall-panels hold at their tops, illustrating reduced buckling length of the same due to lateral bracing
Figure 16:
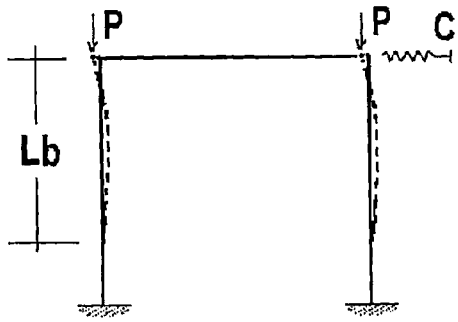
FIG. 16 is a schematic model of a transversal frame of the simplest structure comprising cantilever wall-panels, illustrating sideway of the laterally unbraced structure
Figure 17:
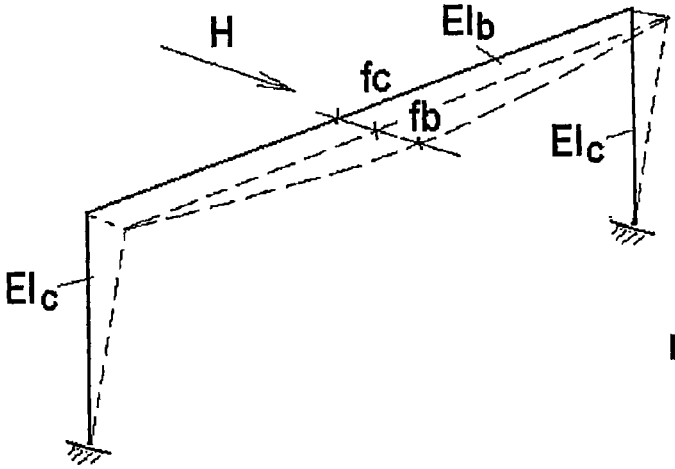
FIG. 17 is a schematic model representing derived from real model shown in FIG. 14, used for determining the parameters of the bracing system of the structure

A long building is constructed by mounting series of transversal fragments one next to another as illustrated in FIG. 12. Wall-panels (1) are aligned along precast multiple strip footings (18), being fixed thereto in the manner described in a) and illustrated in FIG. 4 and FIG. 8. Adjacent wall panels (1) are interconnected indirectly through the common horizontal plane formed of assembled soffit plates of roof units. Roof units are interconnected at few points along their common edges of soffit plates in a usual manner by welded steel inserting joints, capable to withstand both longitudinal and transversal forces. Similar joints are most commonly used for leveling common edges of adjacent soffit plates and are not subject of this invention. The rigid horizontal plane (51) is connected to both gable-wall-panels (52) forming gables by plurality of welded shear joints along the longitudinal edges of last positioned adjacent soffit plates. Wall-panels (1) positioned along two longitudinal sides are thereby substantially braced in transversal direction, being held at their tops by a horizontally stiff roof-ceiling plane (51).

The invention claimed is:

1. A building construction of composite load-bearing vertical wall-panels and composite roof-ceiling units, said building comprising wall-panels of a height greater than 9 meters, aligned and rigidly fixed as cantilevers from strip precast foundations having longitudinal sockets arranged along a perimeter of the building, and each wall panel including a cast concrete inner layer and a cast concrete outer layer, and two interspaced layers of mesh reinforcement placed in each of the cast concrete inner layer and in the cast concrete outer layer, on opposite sides of an insulation layer and an air layer, widths of the wall-panels exactly coinciding with widths of a ceiling unit and a floor unit to ensure precise coincidence of connecting details so that the building having all flat inner surfaces avoids a need for either columns or beams, a width of the ceiling unit being greater than 20 meters, tops of the wall panels being attached to stiff horizontal plane formed ceiling plates interconnected along adjacent edges to be laterally restrained against sideway forces by joining ending plates of the ceiling plates to the wall panels, two steel tubes being anchored to and extending across the cast concrete inner layer and the cast concrete outer layer of each of the wall panels, one of the two tubes supporting the ceiling unit and the other of the two tubes supporting the floor unit, the floor unit being formed of two spaced concrete layers interconnected by steel strip webs, steel strip webs spacing the concrete inner layer and the concrete outer layer of each of the wall panels, the steel strip webs interconnecting the concrete inner layer and the concrete outer layer of each of the wall panels and extending continuously along a length of the concrete layers of the wall panels, the steel strip webs of the wall panels being secured to the steel strip webs of the floor unit, and supports located at an upper end of the two concrete layers of the wall panels bearing the ceiling unit, the supports being formed by a top end portion of an inner concrete layer of the two concrete layers being shorter than a top end portion of the outer concrete layer.

2. A composite, vertical wall-panel comprising two concrete layers, both of the two concrete layers being reinforced substantially with two steel wire mesh layers, the two concrete layers being interconnected continuously throughout an entire length of the panel by at least two steel strip webs so that a gap is formed between the two concrete layers, the gap being filled partially by a layer of thermo-insulation inwardly adhered to an inner concrete layer of the two concrete layers with a rest of the gap between the two concrete layers being used as a separate layer of air ventilation, the strip-webs being anchored to both of the two concrete layers through a plurality of welds along edges of the at least two steel strip webs having arranged steel loops containing holes positioned at the edges into which short steel rod anchors are inserted into the two concrete layers, keeping a distance between the two steel wire mesh layers, additional longitudinal reinforcing bars or prestressing strands being conducted between the two steel wire mesh layers, supports located at an upper end of the two concrete layers for bearing flat-soffit roof units, the supports being formed by a top end portion of an inner concrete layer of the two concrete layers being shorter than a top end portion of the outer concrete layer, an inbuilt steel tube protruding from the two concrete layers, the tube being anchored by being welded perpendicularly to the two steel strip webs to gradually centrically transmit roof load from the steel tube to both of the two concrete layers, without considerable stress concentration, and a connection to the inbuilt steel tube by two bolts extending upwardly from a top surface of the inbuilt steel tube upon which a soffit plate of the flat soffit roof units are slipped over through two holes and fixing the two bolts by nuts a lower portion of the two concrete layers being full solid concrete inclusive of and between the two concrete layers for fixing on a foundation, and supports for bearing a rigid floor unit inside of a horizontal groove formed along an interrupt of the inner concrete layer of the two concrete layers, the inner concrete layer supporting another inbuilt steel tube anchored to both of the two concrete layers, the at least two steel strip webs passing-right-angularly to the another tube, continuously through the horizontal groove for connection with steel strip webs of the floor unit.

* * * * *